US006547466B2

(12) United States Patent
Kageyama et al.

(10) Patent No.: US 6,547,466 B2
(45) Date of Patent: Apr. 15, 2003

(54) MECHANICAL PENCIL

(75) Inventors: Hidehei Kageyama, Kawagoe (JP); Yoshio Noguchi, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/005,163

(22) Filed: Dec. 7, 2001

(65) Prior Publication Data

US 2003/0031498 A1 Feb. 13, 2003

(30) Foreign Application Priority Data

Aug. 13, 2001 (JP) ..... 2001-245537

(51) Int. Cl.[7] ..... B43K 21/16; B43K 21/22
(52) U.S. Cl. ..... 401/67; 401/94
(58) Field of Search ..... 401/67, 92, 93, 401/94

(56) References Cited

U.S. PATENT DOCUMENTS 4,270,870 A * 6/1981 Hashimoto et al. ..... 401/94 X
4,729,684 A * 3/1988 Sakaoka ..... 401/67 X
6,039,485 A * 3/2000 Kageyama et al. ..... 401/67

* cited by examiner

*Primary Examiner*—David J. Walczak
*Assistant Examiner*—Kathleen J. Prunner
(74) *Attorney, Agent, or Firm*—McGinn & Gibb, PLLC

(57) ABSTRACT

A mechanical pencil, includes an external cylinder, a lead delivery mechanism disposed in the external cylinder, the lead delivery mechanism having a lead-fastening chuck which fastens a lead and moves back and forth in the external cylinder to deliver the lead toward a front end of the external cylinder, a lead holder disposed before the lead delivery mechanism in the external cylinder to gently hold a lead, and a guide member arranged between the lead-fastening chuck and the lead holder in the external cylinder and always urged backwardly toward the lead-fastening chuck to protect a lead portion between the lead-fastening chuck and a lead holding portion of the lead holder.

19 Claims, 11 Drawing Sheets

MECHANICAL PENCIL

BACKGROUND OF THE INVENTION

1. Field of the Invention

The present invention relates to a mechanical pencil, and more particularly to a mechanical pencil including an external cylinder, a lead delivery mechanism set in the external cylinder, and a lead holder set before the lead delivery mechanism in the external cylinder to gently hold a lead, in which the lead delivery mechanism has a lead-fastening chuck which fastens a lead and moves back and forth in the external cylinder, thereby to deliver the lead toward the front end of the external cylinder.

2. Description of the Related Art

In some conventional mechanical pencils, a lead-fastening chuck generally has a plurality of chuck elements and fastens a lead by holding the lead with the chuck elements under the normal state. A slider-type lead pipe is set to the front end of an external cylinder, depending on the type of mechanical pencil, to surround the circumference of a lead portion positioned to the front end of the external cylinder. When it is necessary to protrude the lead beyond the front end of the external cylinder in order to perform writing, or when it is necessary to further protrude the lead beyond the front end of the external cylinder because the lead is exhausted due to writing, it is possible to deliver the lead forwardly by operating a lead delivery mechanism.

More specifically, a lead-fastening chuck and a chuck ring for fastening the lead-fastening chuck advance by a predetermined distance together with the lead and moreover, only the lead-fastening chuck advances by being released from the chuck ring, and the chuck elements of the lead-fastening chuck release the lead. The lead holder set before the lead delivery mechanism holds the advanced lead, the lead-fastening chuck and chuck ring retreat to their initial positions, and the lead-fastening chuck firmly holds the lead again.

Thus, the lead is delivered by a predetermined distance. Moreover, for a mechanical pencil having a slider-type lead pipe, when a lead pipe remains in an external cylinder and a lead-fastening chuck advances, the lead-fastening chuck presses a lead holder and the lead pipe forwardly.

As described above, in a conventional mechanical pencil, a moving margin for a lead-fastening chuck to advance in order to deliver a lead is necessary between the lead-fastening chuck and a lead holder, and a spatial portion is formed in the moving margin. Because a broken lead can enter the spatial portion, the broken lead may enter the gap between the chuck elements of the lead-fastening chuck or may remain between the lead-fastening chuck and the lead holder, thereby preventing (or hindering) the lead-fastening chuck from advancing and rendering the chuck inoperable.

SUMMARY OF THE INVENTION

In view of the foregoing and other problems, drawbacks, and disadvantages of the conventional structures, an object of the present invention is to provide a mechanical pencil capable of protecting a lead present between a lead-fastening chuck and a lead holder, and preventing a broken lead from entering the gap between them.

To attain the above and other objects, in a first aspect of the present invention, a mechanical pencil includes an external cylinder, a lead delivery mechanism disposed in the external cylinder, and a lead holder disposed before the lead delivery mechanism in the external cylinder to gently hold a lead. Preferably, the lead delivery mechanism has a lead-fastening chuck which fastens a lead and moves back and forth in the external cylinder, to deliver the lead toward the front end of the external cylinder. A guide member preferably is arranged between the lead-fastening chuck and the lead holder in the external cylinder and is always urged backwardly toward the lead-fastening chuck to protect a lead portion between the lead-fastening chuck and a lead holding portion of the lead holder.

Because the lead portion formed before the lead-fastening chuck is protected by the guide member set between the lead-fastening chuck and the lead holder, a broken lead can be prevented from entering (and remaining) in a space between the lead-fastening chuck and the lead holder, thereby preventing a malfunction. Because the guide member is always urged backwardly toward the lead-fastening chuck, a gap always can be prevented from being formed in the axial direction between the guide member and the lead-fastening chuck and the lead portion ahead of the lead-fastening chuck can be fixedly protected.

Moreover, it is possible to always overlap the front end of the guide member and the rear end of the lead holder with each other in the axial direction by inserting either of the front end or the rear end into the other end. Because the front end of the guide member always overlaps with the rear end of the lead holder in the axial direction, it is possible to fixedly protect the lead portion formed between the lead-fastening chuck and the lead holder by always preventing a gap from being formed in the axial direction between the guide member and the lead holder.

Furthermore, the guide member can have a plurality of protective elements separated from each other in the circumferential direction to protect the outer periphery of a lead, and it is possible to insert the rear end of the lead holder between the adjacent protective elements.

Furthermore, the guide member can be formed by an annular flange and a plurality of insertion legs extending forward from the flange, and the rear end of the lead holder can be inserted between the adjacent insertion legs. Alternatively, the guide member can be formed by an annular flange and a cylindrical portion before the flange, with a plurality of ribs formed on the inner periphery of the cylindrical portion separately from each other in the circumferential direction, and the rear end of the lead holder can be inserted between the adjacent ribs.

Furthermore, the rear end of the lead holder can have a plurality of holding elements separated from each other in the circumferential direction to hold the outer periphery of a lead, and the front end of the guide member can be inserted between the adjacent holding elements.

Furthermore, the rear end of the lead holder can be formed into a cylindrical portion and a plurality of ribs can be formed on the inner periphery of the cylindrical portion separately from each other in the circumferential direction, and the front end of the guide member can be inserted between the adjacent ribs. Alternatively, the rear end of the lead holder can have a plurality of insertion legs extending backward, and the front end of the guide member can be inserted between the adjacent insertion legs.

Further, a protrusion may be formed elastically contacting the inner periphery of the external cylinder on the outer periphery of the lead holder. Thus, the lead holder can fixedly hold a lead so that the lead holder is not easily moved due to the friction with the inside of the external cylinder by, for example, the load received from the lead. By forming the protrusion integrally with the lead holder, the number of components and the assembly labor can be decreased.

Moreover, the lead holder may be formed so that it can be pushed forwardly by the guide member in the external cylinder, and it can be held at an advancing position during writing. Alternatively, the lead holder can be formed so that it does not move in the external cylinder under any operation.

The present disclosure relates to subject matter contained in Japanese Patent Application No. 2001-245537, filed on Aug. 13, 2001, which is expressly incorporated herein by reference in its entirety.

DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

Embodiments of the present invention will be described below by referring to the accompanying drawings.

First Embodiment

Figure 1:
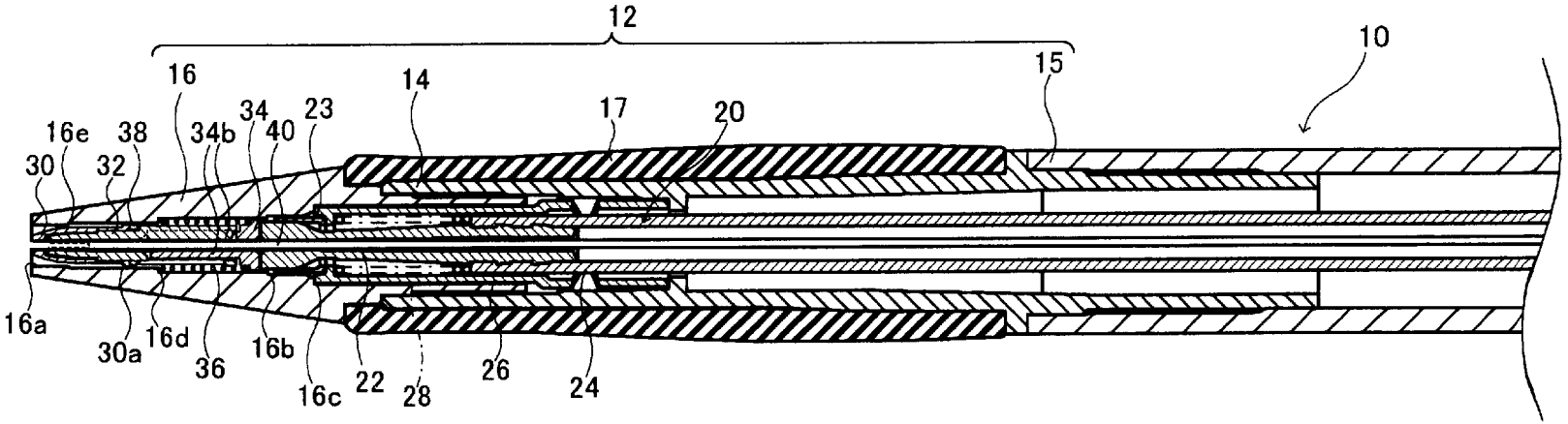
FIG. 1 is a longitudinal sectional view showing a first embodiment of a mechanical pencil 10 of the present invention.
Figure 2:
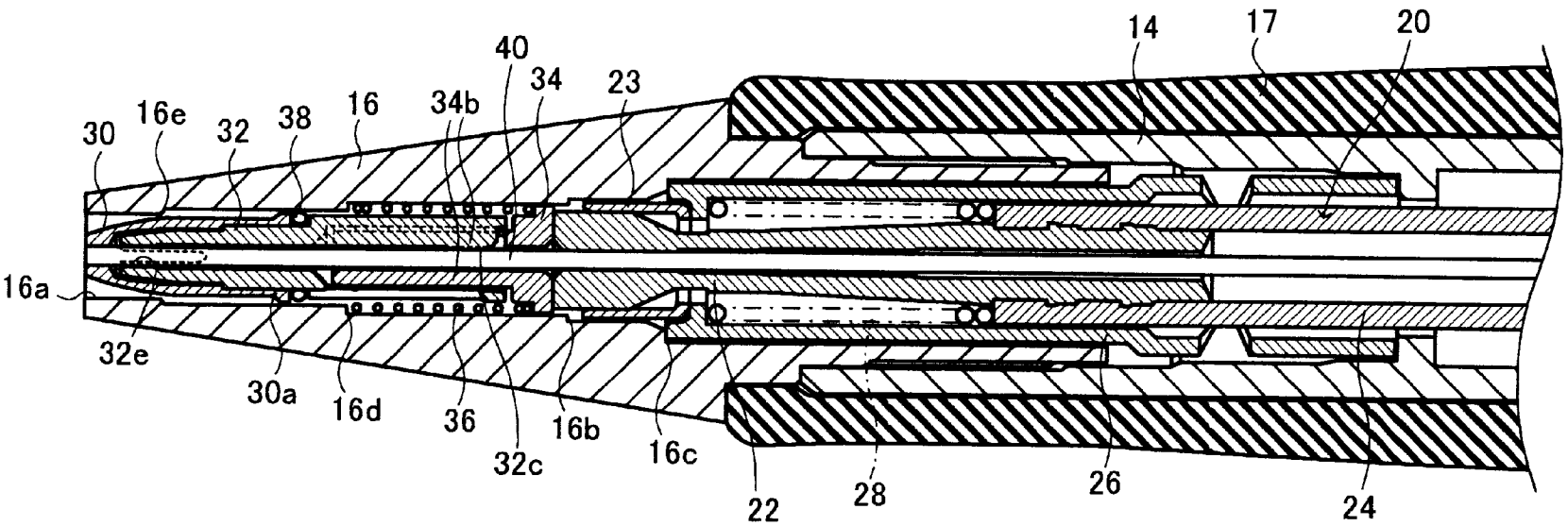
FIG. 2 is a sectional view of an essential portion of the first embodiment, showing a state of retracting a front-end chip and a lead into a front tool when writing is not performed.

FIG. 1 is a general longitudinal sectional view showing a first embodiment of a mechanical pencil 10 of the present invention and FIG. 2 is a sectional view of an essential portion of the first embodiment.

In FIG. 1, the mechanical pencil lo has an external cylinder 12. The external cylinder 12 can be optionally formed. However, the external cylinder 12 of the embodiment of FIG. 1 includes a front cylinder 14, a rear cylinder 15, and a front tool 16. The front cylinder 14 and rear cylinder 15, and the front cylinder 14 and front tool 16 are respectively combined with each other by a screw connection. Moreover, an elastic material 17 is attached around the outer periphery of the front cylinder 14.

A conventional lead delivery mechanism 20 is disposed in the external cylinder 12. The lead delivery mechanism 20 has a lead-fastening chuck 22, a chuck ring 23 disposed around the outer periphery of the lead-fastening chuck 22, a lead tank 24 into whose front end the rear end of the lead-fastening chuck 22 is pressed and fixed, a sleeve 26 for controlling backward movement of the chuck ring 23, and a chuck spring 28 (an elastic body) disposed between the sleeve 26 and the lead tank 24 to urge the lead tank 24 and lead-fastening chuck 22 backward.

The lead-fastening chuck 22 is positioned at the foremost end in the lead delivery mechanism 20, and includes a plurality of chuck elements divided (e.g., through slits formed in the chuck 22) so that the chuck elements fasten (e.g., hold) a lead 40. The lead-fastening chuck 22 can reciprocate back and forth, to deliver the lead 40 by a predetermined distance.

The chuck ring 23 normally surrounds the outside of chuck elements of the lead-fastening chuck 22 to prevent the chuck elements from expanding, and the lead 40 is held by the chuck ring 23 and the chuck elements. The chuck ring 23 can reciprocate back and forth by a predetermined distance together with the lead-fastening chuck 22, and its forward movement is controlled by a step portion 16*b* formed on the inner periphery of the front tool 16. The front end of the sleeve 26 contacts a step portion 16*c* formed behind the step portion 16*b* on the inner periphery of the front tool 16.

A front-end chip (or front-end pipe) 30 is arranged at the front-end opening 16*a* of the front tool 16 and the front-end chip 30 surrounds and protects the portion of the lead 40 passing through the front-end opening 16*a*. The front-end pipe 30 is preferably a slider-type front-end pipe capable of protruding or retracting through the front-end opening 16*a* of the front tool 16.

When the front-end chip 30 maximally protrudes from the front-end opening 16*a* of the front tool 16, a flange 30*a* of the front-end chip 30 is fixed to a step portion 16*e* formed at the front end of the inner periphery of the front tool 16. A lead holder 32 is inserted into the front-end chip 30 from its rear end. The lead holder 32 extends backward from the front-end chip 30 and a first lead-holding portion 32*c* and a second lead-holding portion 32*e* for holding the lead 40 (described below) are formed on the inner periphery of the lead holder 32.

Figure 7:
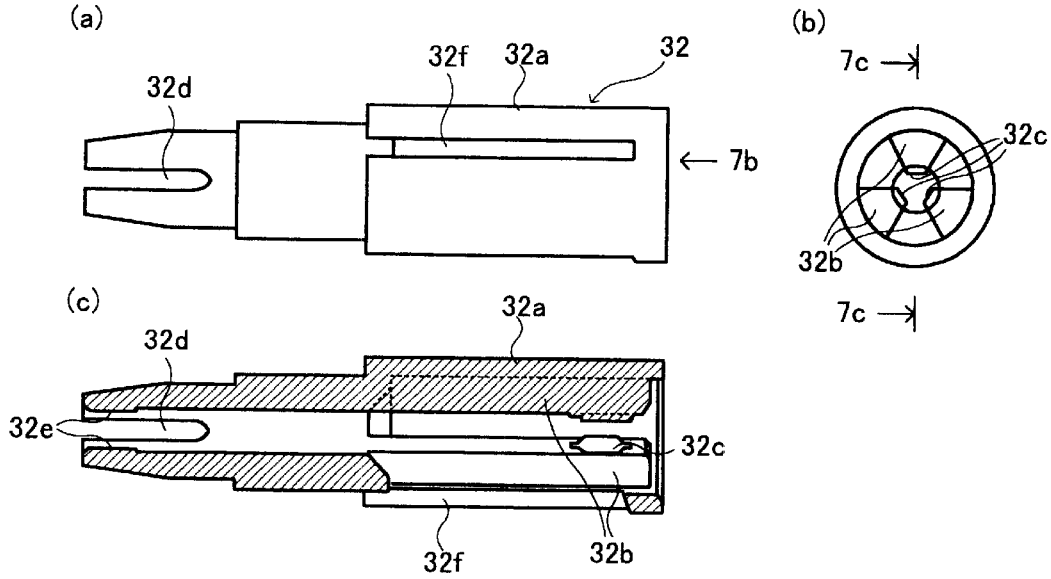
FIG. 7A is a side view of a lead holder of the first embodiment.
FIG. 7B is the lead holder in FIG. 7A viewed from an arrow 7*b* in FIG. 7A.
FIG. 7C is a sectional view taken along a line 7*c*—7*c* in FIG. 7B.

As shown in greater detail in FIG. 7, on a cylindrical portion 32*a* formed at the rear end of the lead holder 32, a plurality of longitudinal slots 32*f* (e.g., three slots shown in this non-limiting example) are formed. Ribs (holding elements) 32*b* protruding in the inside-diameter direction are formed on the inner periphery of a portion on which the longitudinal slots 32*f* are not formed. The first lead-holding portion 32*c* protruding in the inside-diameter direction and contacting the lead 40 is further formed on the inner periphery of rear end of the ribs 32*b*.

Additionally, on the front end of the lead holder 32, a plurality of slits 32*d* (e.g., two slits in this non-limiting example) extending backward from the front end of the lead holder 32 are formed and the second lead-holding portion 32*e* protruding in the inside-diameter direction and contacting the lead 40 is formed on the inner periphery of the front end of a portion where the slits 32*d* are not formed. The first lead-holding portion 32*c* and second lead-holding portion 32*e* can be deformed by the longitudinal slots 32*f* and slits 32*d* in the diameter direction so as to elastically hold the lead 40.

A guide pipe 34, serving as a guide member for holding the lead 40 and protecting the portion of the lead 40 present between the lead holder 32 and the lead-fastening chuck 22, is disposed between the lead holder 32 and the lead-fastening chuck 22.

Figure 8:
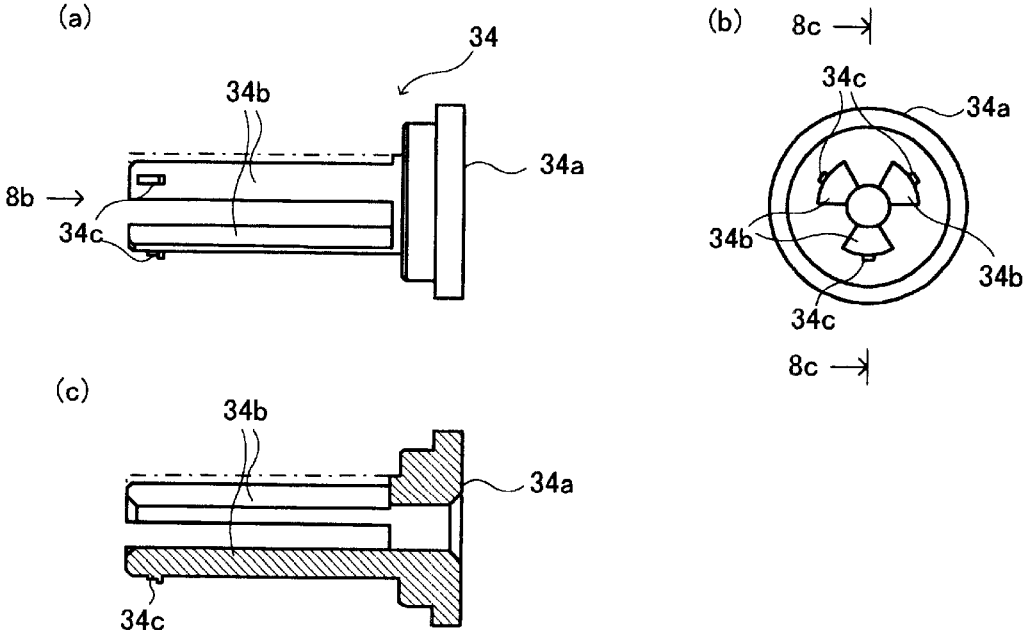
FIG. 8A is a side view of a guide pipe of the first embodiment.
FIG. 8B is the guide pipe viewed from an arrow 8*b* in FIG. 8A.
FIG. 8C is a sectional view taken along a line 8*c*—8*c* in FIG. 8B.

As shown in FIG. 8, particularly, the guide pipe 34 has a substantially annular flange 34*a* and a plurality of insertion legs (protective elements) 34*b* extending forwardly from the flange 34*a* and insertable between the adjacent ribs 32*b* of the lead holder 32. A removal-prevention protrusion 34*c* is formed on the outer periphery of the front end of the insertion legs 34*b* and fitted into the longitudinal slots 32*f* of the lead holder 32.

A return spring 36 is inserted between the guide pipe 34 and a step portion 16*d* formed before (e.g., rearwardly of) the step portion 16*b* of the front tool 16, the guide pipe 34 is always urged backwardly by the return spring 36, and thus the flange 34*a* of the guide pipe 34 contacts the front end face of the lead-fastening chuck 22.

An O-ring 38 is disposed between the rear end face of the front-end chip 30 and the intermediate outer periphery of the lead holder 32 and elastically contacts the inner periphery of the front tool 16.

Figure 9:
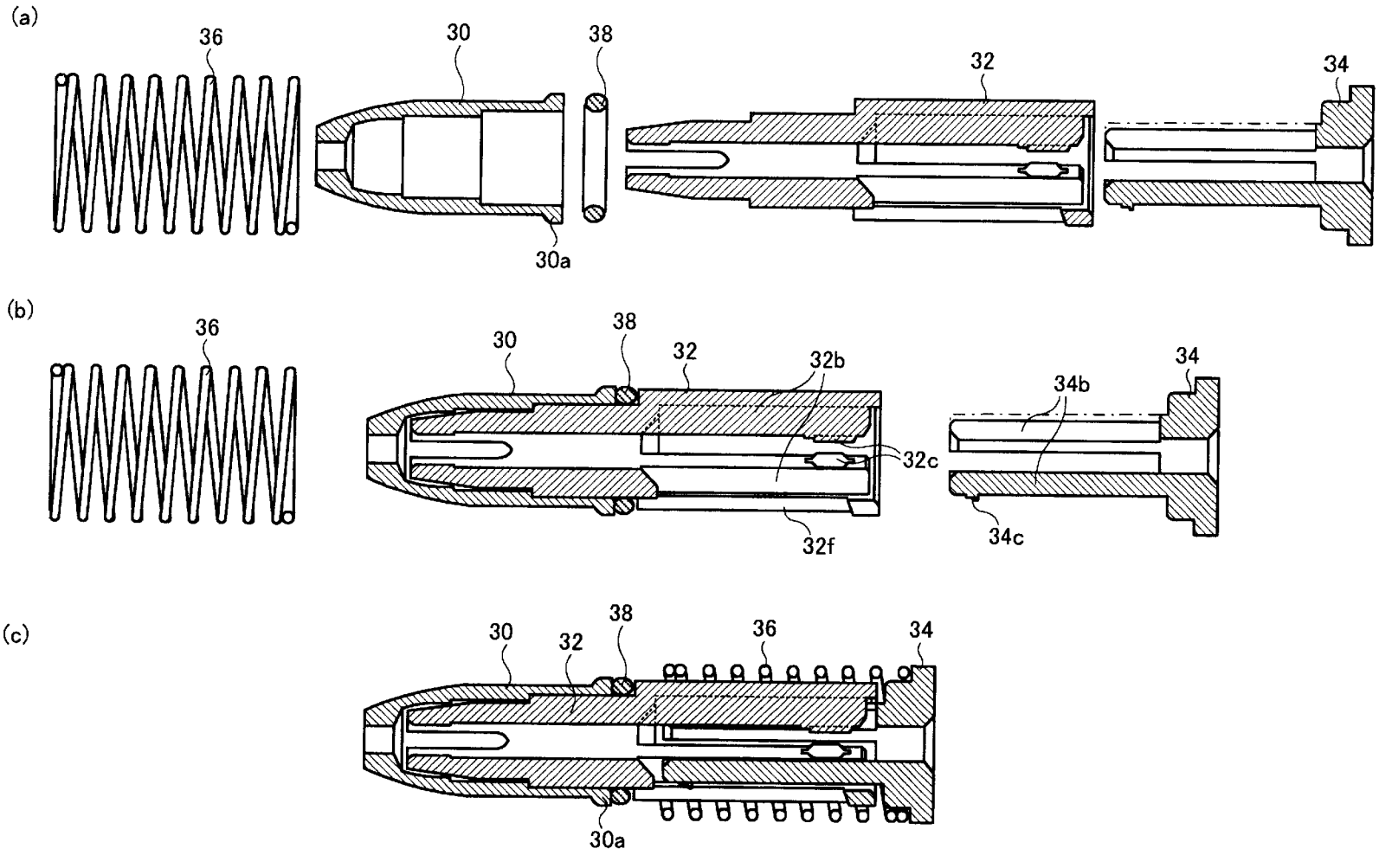
FIGS. 9A to 9C are illustrations showing a procedure for assembling a front-end chip, a lead holder, a guide pipe, a return spring, and an O-ring.
Figure 10:
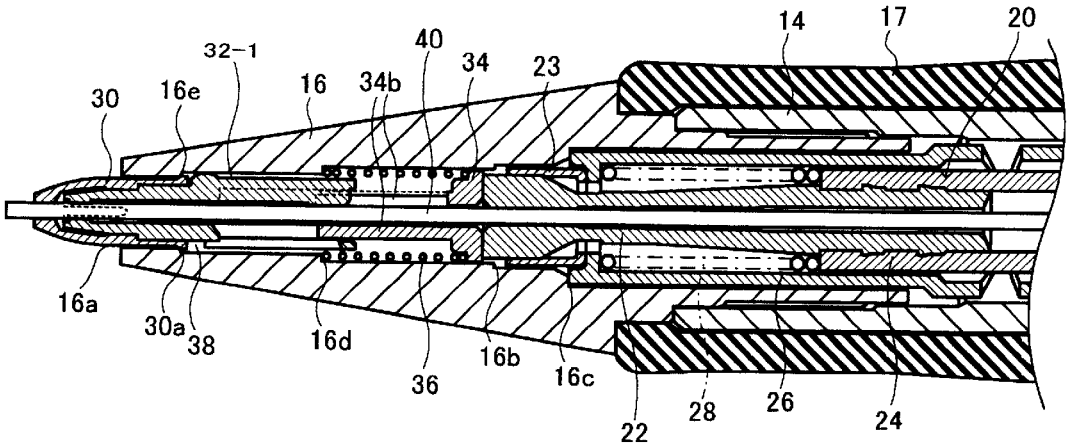
FIG. 10 is a sectional view of an essential portion of a second embodiment of the present invention, showing a writing enable state in which the front end of a front-end chip and the tip of a lead protrude from the front-end opening of a front tool.
Figure 11:
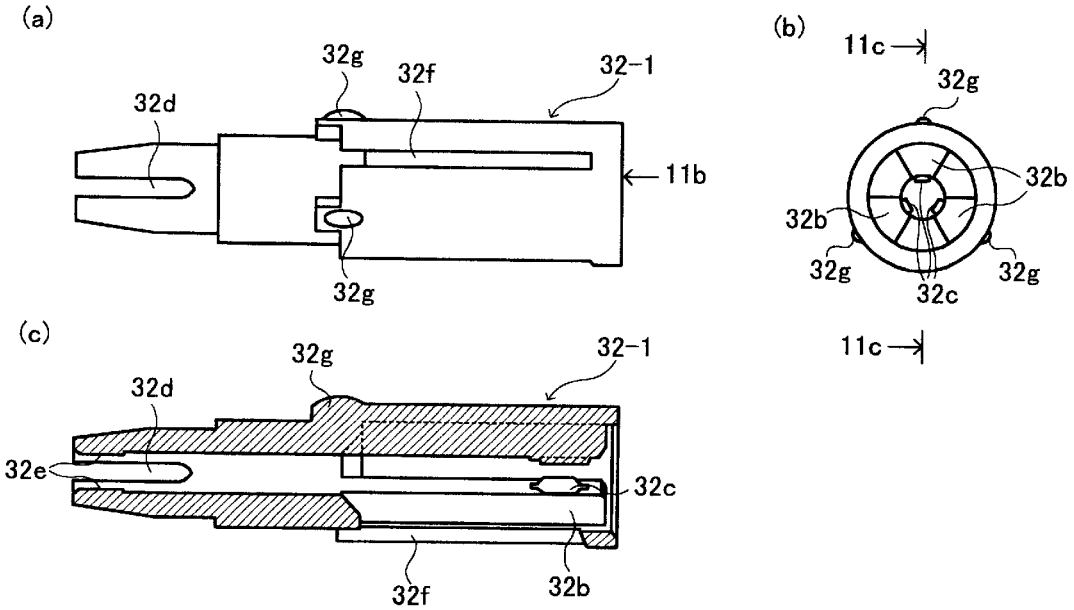
FIG. 11A is a side view of a lead holder of the second embodiment.
FIG. 11B is the lead holder viewed from the arrow 11*b* in FIG. 11A.
FIG. 11C is a sectional view taken along a line 11*c*—11*c* in FIG. 11B.

As shown in FIG. 9, to assemble the above front-end chip 30, lead holder 32, guide pipe 34, return spring 36, and O-ring 38, the lead holder 32 is inserted into the rear of the front-end chip 30 with the O-ring 38 being placed therebetween. Then, the return spring 36 is externally inserted from the front of the front-end chip 30, the insertion legs 34*b* of the guide pipe 34 are inserted between the adjacent ribs 32*b* of the lead holder 32, and the removal-prevention protrusion 34*c* is engaged into the longitudinal slits 32*f* of the lead holder 32.

A unit thus assembled is inserted from the rear of the front tool 16 to fix the flange 30*a* of the front-end chip 30 at the step portion 16*e*, and to fix the front end of the return spring 36 at the step portion 16d of the front tool 16. The guide pipe 34 is pressed backwardly by the force of the return spring 36. However, because the removal-prevention protrusion 34*c* of the guide pipe 34 is engaged with the rear end of the longitudinal slots 32*f* of the lead holder 32, the guide pipe 34 is not removed.

Moreover, the front end of the lead delivery mechanism 20 is inserted into the front tool 16, the front tool 16 is combined with the front cylinder 14, the front cylinder 14 is combined with the rear cylinder 15, and a conventional knock cap (not illustrated) is removably combined with the lead tank 24 of the lead delivery mechanism 20. Thus, the entire assembly is completed.

The functions and operations of the mechanical pencil 10 formed as described above will be described below.

FIG. 2 shows a state in which the front-end chip 30 is retracted into the front tool 16 when writing is not performed. Under the retracted state, the portion of the lead 40 at the front-end side of the lead-fastening chuck 22 is surrounded and protected by the ribs 32*b* of the lead holder 32 and the insertion legs 34*b* of the guide pipe 34.

Figure 3:
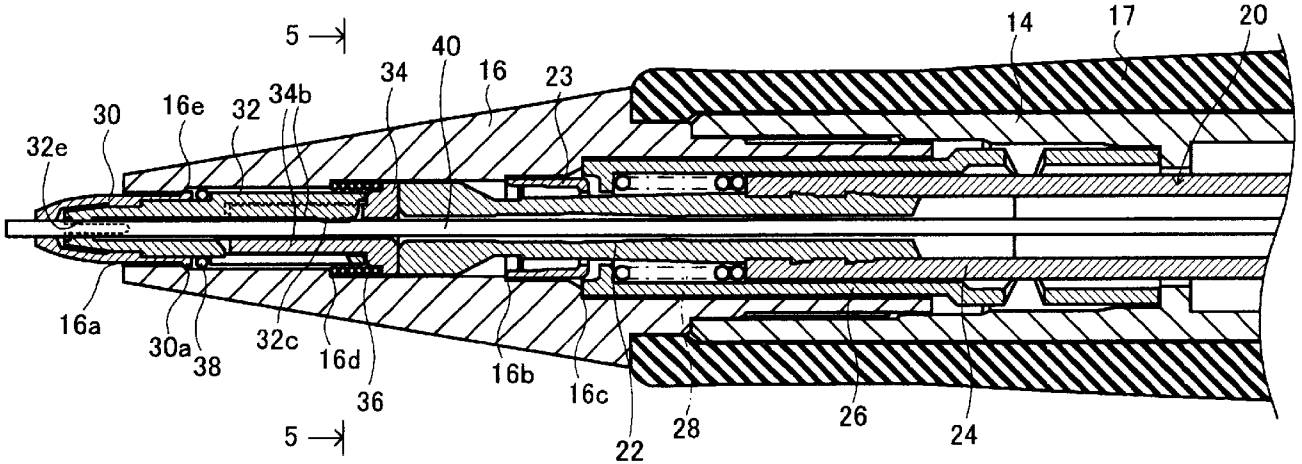
FIG. 3 is a sectional view of an essential portion of the first embodiment, showing a state of operating a lead delivery mechanism 20.

From the state in FIG. 2, a knock cap (not illustrated) is knocked (e.g., depressed) forwardly to operate the lead delivery mechanism 20. Then, the lead tank 24 and lead-fastening chuck 22 advance and the lead-fastening chuck 22 presses the guide pipe 34 forwardly against the urging force of the return spring 36 as shown in FIG. 3.

Figure 5:
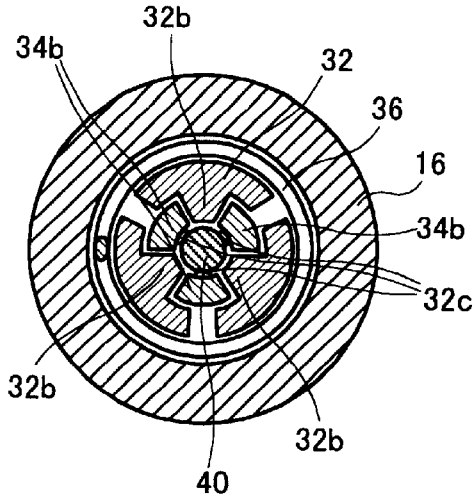
FIG. 5 is a sectional view taken along a line 5—5 in FIG. 3.

Therefore, the flange 34*a* of the guide pipe 34 presses the lead holder 32 forwardly, and the front end of the front-end chip 30 protrudes from the front-end opening 16*a* of the front tool 16. As such, the insertion legs 34*b* of the guide pipe 34 are inserted between the adjacent ribs 32*b* of the lead holder 32. Therefore, when the guide pipe 34 advances, the insertion legs 34*b* do not interfere with or disturb the lead holder 32. As shown in FIG. 5, the portion of the lead 40 at the front-end side of the lead-fastening chuck 22 is entirely surrounded and protected by the insertion legs 34*b* of the guide pipe 34 and the ribs 32*b* of the lead holder 32.

The front-end chip 30 and the lead holder 32 pressed forwardly keep advanced positions in accordance with the friction with the O-ring 38. Moreover, the lead-fastening chuck 22 advances together with the chuck ring 23 until the ring 23 contacts the step portion 16*b*. When the lead 40 advances and then only the lead-fastening chuck 22 advances, the lead 40 is released from the fastened (held) state by the lead-fastening chuck 22.

When the knock force for the knock cap is released, the lead-fastening chuck 22, lead tank 24, and chuck ring 23 retract to their initial positions by the urging force of the chuck spring 28. Moreover, the guide pipe 34 is also made to follow the retraction of the lead-fastening chuck 22 by the return spring 36. In this case, because the first lead-holding portion 32*c* and second lead-holding portion 32*e* of the lead holder 32 hold the lead 40, the lead 40 does not retreat (retract) but it keeps an advanced state. Moreover, in this case, because the lead holder 32 keeps an advanced position by the friction with the O-ring 38, it does not retract together with the lead 40. Thus, the lead 40 and front-end chip 30 are delivered and the lead 40 is fastened by the lead-fastening chuck 22 again and the writing enable state is realized as shown in FIG. 4.

Figure 4:
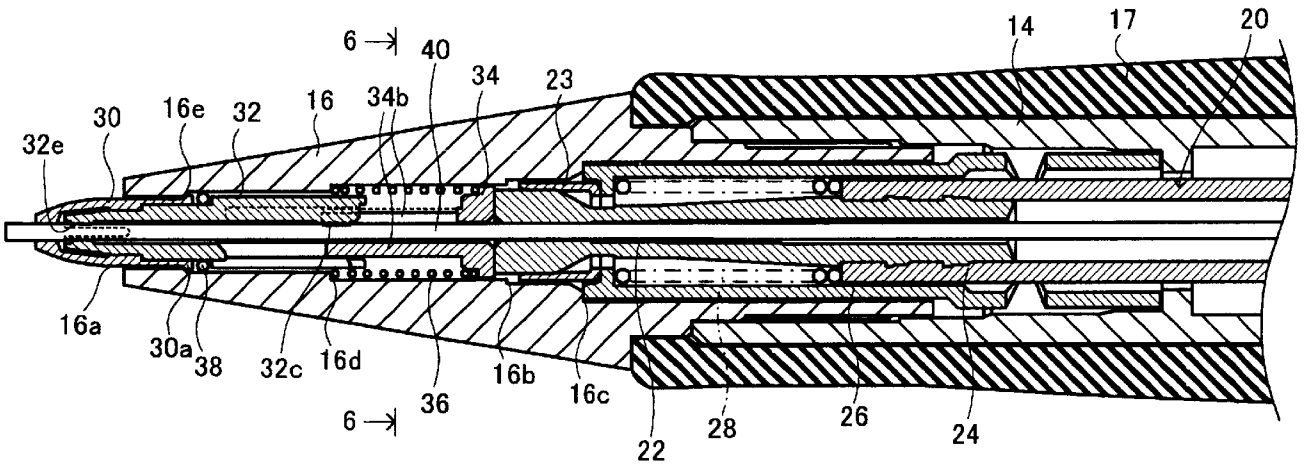
FIG. 4 is a sectional view of an essential portion of the first embodiment, showing a writing enable state in which the front end of a front-end chip and the tip of a lead protrude from the front-end opening of a front tool.
Figure 6:
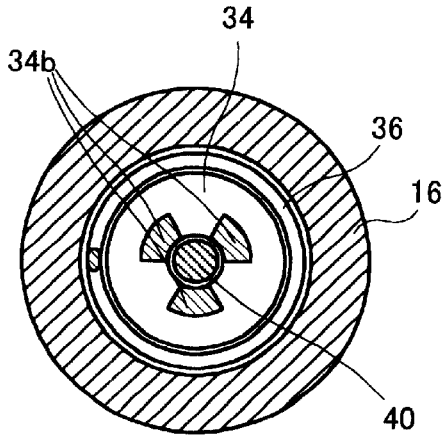
FIG. 6 is a sectional view taken along a line 6—6 in FIG. 4.

Under the state in FIG. 4, an axial space is formed between the first lead-holding portion 32*c* of the lead holder 32 and the lead-fastening chuck 22. However, because the guide pipe 34 is arranged in the space and the insertion legs 34*b* of the guide pipe 34 surround the outer periphery of the lead 40 (e.g., see FIG. 6), the lead 40 is protected and it is not easily broken. Even if the lead is broken, it is possible to prevent the broken lead from stopping (remaining) in the space.

Thus, a product can be provided causing no malfunction due to a stopped lead. Further, because it is only necessary to add the guide pipe 34, the number of components is not greatly increased and it is easy to assemble the product.

Additionally even when a very short lead is held by the lead-fastening chuck 22, if a lead having a length slightly larger than a hole diameter defined by a plurality of chuck elements when the chuck element of the lead-fastening chuck 22 releases the lead at the time of lead delivery is used, then it is guided by the guide pipe 34 without rotating transversely and the lead can be delivered.

Further, even when a lead shorter than the length between the lead-fastening chuck 22 and the first lead-holding portion 32*c* of the lead holder 32 is delivered from the lead-fastening chuck 22, it can advance straight (directly) to the first holding portion 32*c* of the lead holder 32 by being guided by the guide pipe 34. Therefore, such a short lead can be used and the length of a residual lead can be reduced.

Second Embodiment

FIGS. 10 and 11A–11C illustrate a second embodiment of the present invention.

In FIGS. 10 and 11A–11C, a portion (not illustrated) is substantially the same as that of the first embodiment. Components the same as those of the first embodiment are provided with the same reference numerals and their detailed description is omitted.

In the second embodiment, a protrusion 32*g* protruding in the outside-diameter direction is formed on the outer periphery of a lead holder 32-1 instead of the O-ring 38 of the first embodiment. Therefore, the lead holder 32-1 is preferably formed by a soft material. Thus, the number of components and the labor for assembling the mechanical pencil can be reduced.

Third Embodiment

Figure 12:
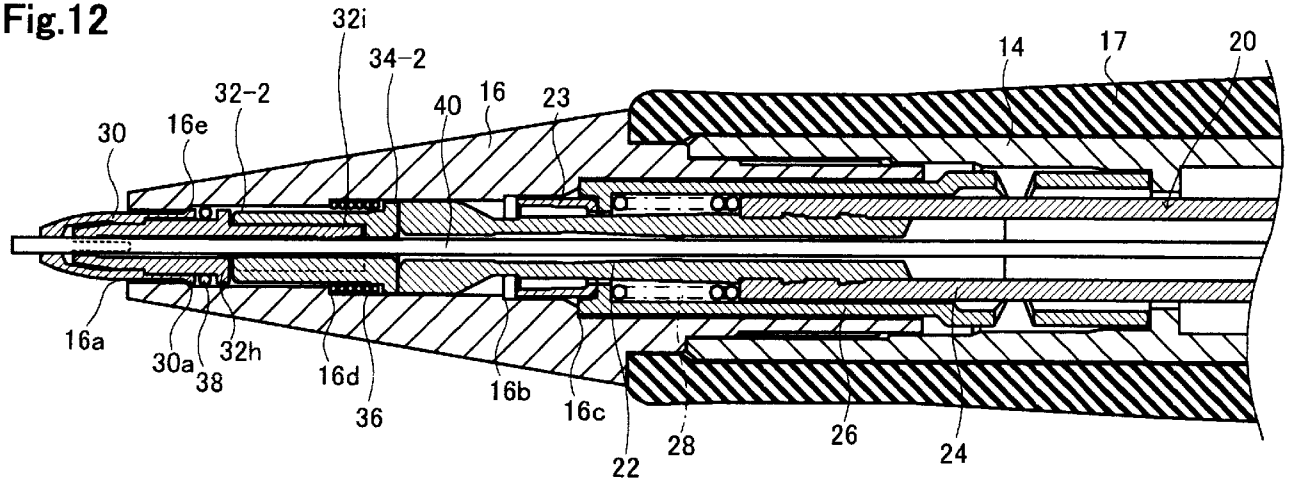
FIG. 12 is a sectional view of an essential portion of a third embodiment of the present invention, showing a state of operating a lead delivery mechanism.
Figure 13:
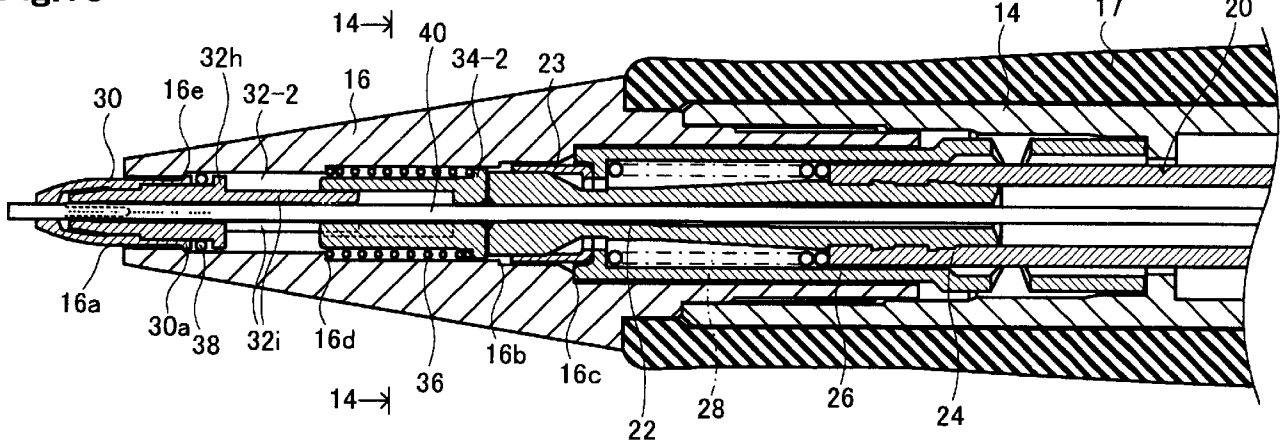
FIG. 13 is a sectional view of an essential portion of the third embodiment, showing a writing enable state in which the front end of a front-end chip and the tip of a lead protrude from the front-end opening of a front tool.
Figure 14:
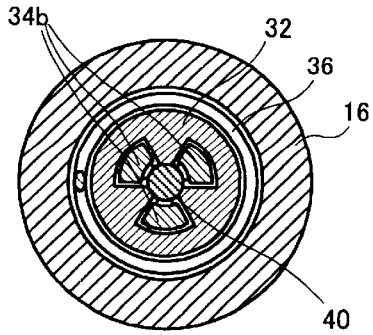
FIG. 14 is a sectional view taken along a line 14—14 in FIG. 13.

FIGS. 12 and 13 illustrate a third embodiment of the present invention. In FIGS. 12 and 13, a not-illustrated portion is substantially the same as that of the first embodiment. Moreover, components the same as those of the first embodiment are provided with the same reference numerals and their description is omitted.

Figure 15:
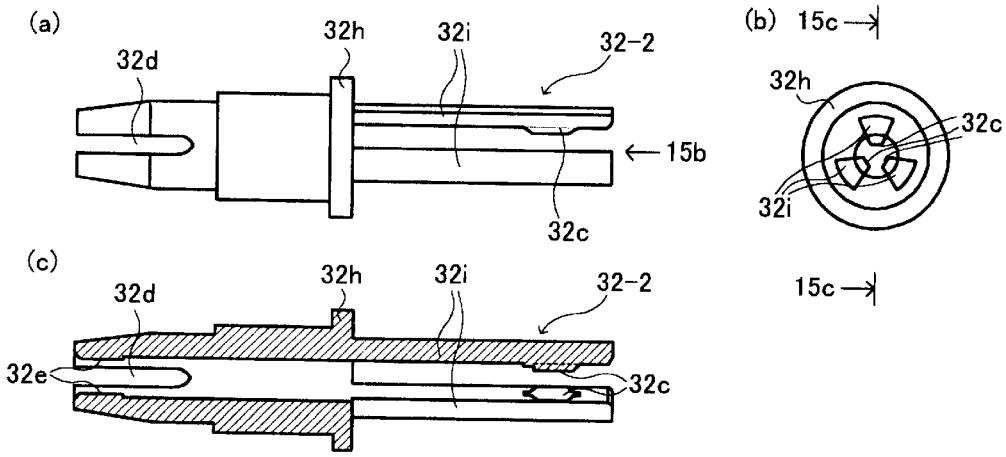
FIG. 15A is a side view of a lead holder of the third embodiment.
FIG. 15B is the lead holder viewed from an arrow 15*b* in FIG. 15A.
FIG. 15C is a sectional view taken along a line 15*c*—15*c* in FIG. 15B.

Configurations of a lead holder 32-2 and a guide pipe 34-2 of the third embodiment are different from configurations of those of the first embodiment. As shown in FIGS. 15A–15C, a flange 32*h* is formed at the central portion of the lead holder 32-2 and a plurality of insertion legs (holding elements) 32*i* extend backwardly from the flange 32*h*. Moreover, a first lead-holding portion 32*c* is formed on the inner periphery of the rear end of insertion legs 32*i*.

Figure 16:
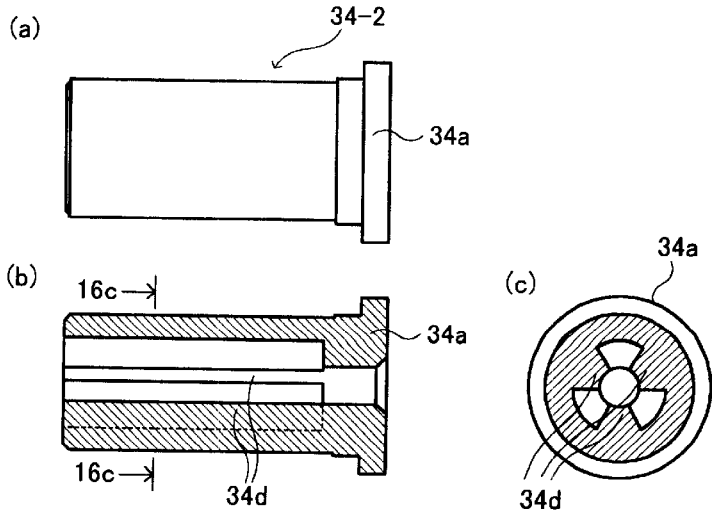
FIG. 16A is a side view of a guide pipe of the third embodiment.
FIG. 16B is a longitudinal sectional view of the guide pipe in FIG. 16A.
FIG. 16C is a cross sectional view taken along a line 16*c*—16*c* in FIG. 16B.
Figure 17:
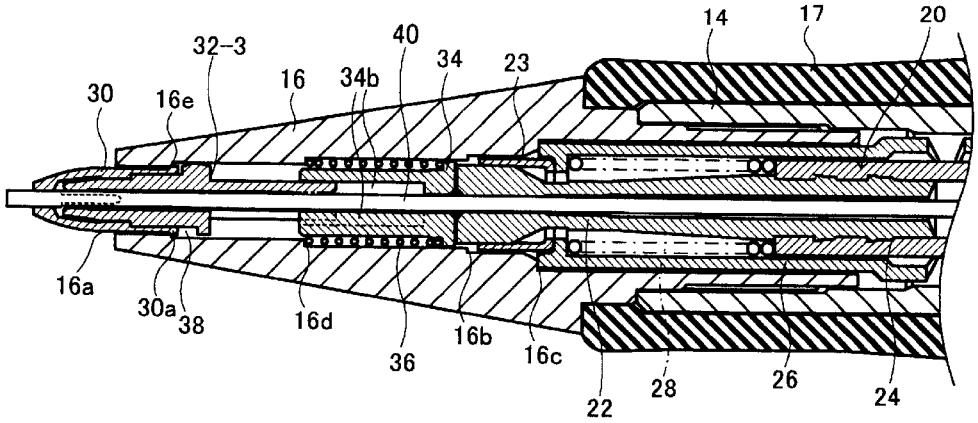
FIG. 17 is a sectional view of an essential portion of a fourth embodiment of the present invention, showing a writing enable state in which the front end of a front-end chip and the tip of a lead protrude from the front-end opening of a front tool.
Figure 18:
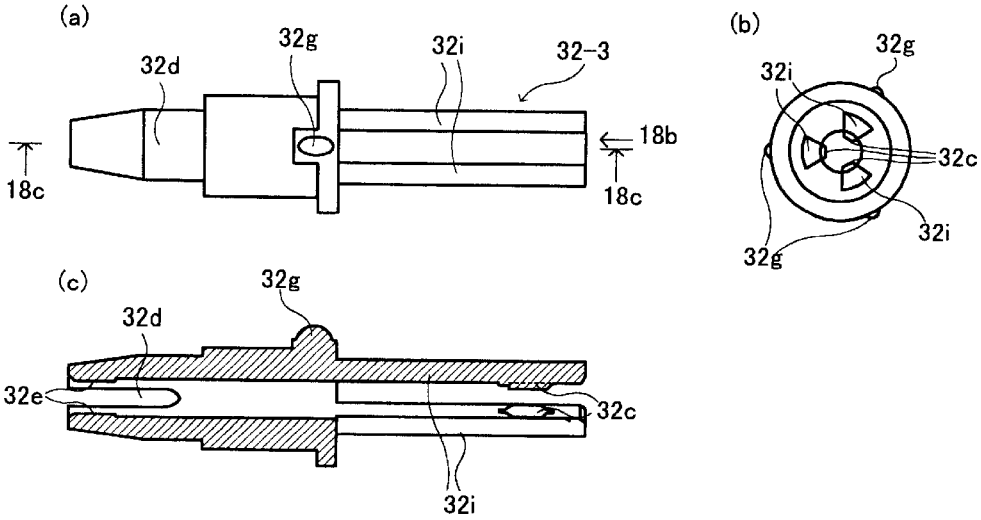
FIG. 18A is a side view of a lead holder of the fourth embodiment.
FIG. 18B is the lead holder viewed from an arrow 18*b* in FIG. 18A.
FIG. 18C is a sectional view taken along a line 18*c*—18*c* in FIG. 18A.

Further, as shown in FIGS. 16A–16B, the front side of a flange 34*a* of the guide pipe 34-2 generally forms not an insertion leg but a cylindrical shape and a plurality of ribs (protective elements) (e.g., three ribs in this non-limiting example) 34*d* separate from each other in the circumferential direction and protruding in the inside-diameter direction are formed on the inner periphery of the cylindrical shape. The insertion legs 32*i* can be inserted between the adjacent ribs 34*d*.

FIG. 12 shows a state in which a knock cap (not-illustrated) is knocked (depressed) forwardly. Similarly to the first embodiment, a lead tank 24 and a lead-fastening chuck 22 advance and the front end of the guide pipe 34-2 or the flange 34*a* presses the lead holder 32-2 forwardly. In this case, the insertion legs 32*i* of the lead holder 32-2 are inserted between the adjacent ribs 34*d* of the guide pipe 34-2. Therefore, the ribs 34*d* of the guide pipe 34-2 do not interfere with or disturb the lead holder 32-2. The portion of a lead 40 at the front-end side of the lead-fastening chuck 22 is entirely surrounded and protected by the ribs 34*d* of the guide pipe 34-2 and the insertion legs 32*i* of the lead holder 32-2.

Moreover, when releasing the knock force for the knock cap, the lead-fastening chuck 22, a lead tank 24, and a chuck ring 23 retract to their initial positions and the guide pipe 34-2 is made to follow the retraction of the lead-fastening chuck 22 as shown in FIG. 13. An axis-directional space is formed between a first lead-holding portion 32*c* of the lead holder 32-2 and the lead-fastening chuck 22. However, the guide pipe 34-2 is arranged in the space and the ribs 34*d* of the guide pipe 34-2 surround the outer periphery of the lead 40. Therefore, the lead 40 is protected and broken leads can be prevented from collecting in the space.

Further, the third embodiment achieves the same advantages as the first embodiment.

Fourth Embodiment

FIGS. 17 and 18A–18C illustrate a fourth embodiment of the present invention. In FIGS. 17 and 18A–18C, a portion (not-illustrated) is substantially the same as that of the third embodiment. Moreover, components the same as those of the first embodiment are provided with the same reference numerals and their description is omitted.

In the fourth embodiment, the O-ring 38 inserted between the rear end face of the front-end chip 30 and the intermediate outer periphery of the lead holder 32-2 of the third embodiment is omitted.

That is, in the fourth embodiment, a protrusion 32*g* protruding in the outside-diameter direction is formed on the outer periphery of a lead holder 32-3 instead of the O-ring 38 of the third embodiment. Therefore, the lead holder 32-3 is preferably formed by a soft material. Thus, the number of components and the labor for assembling the mechanical pencil can be reduced.

Fifth Embodiment

Figure 19:
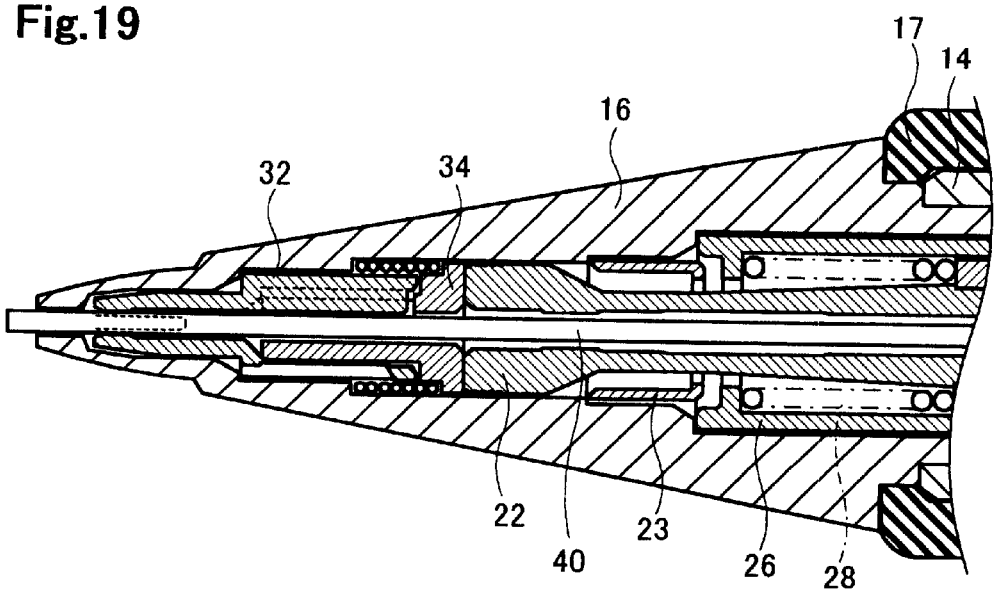
FIG. 19 is a sectional view of an essential portion of a fifth embodiment, showing a state of operating a lead delivery mechanism.
Figure 20:
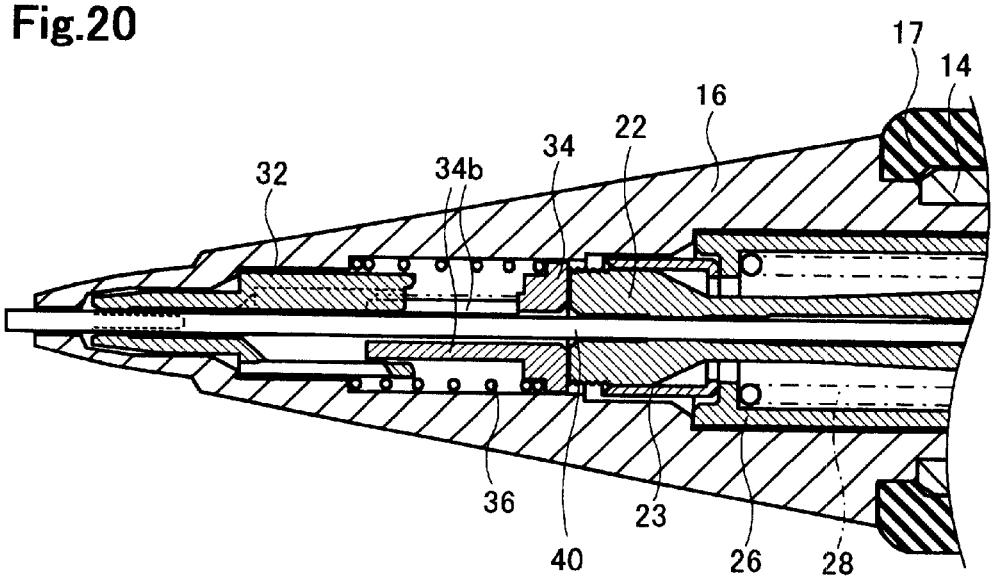
FIG. 20 is a sectional view of an essential portion of the fifth embodiment, showing a writing enable state in which the tip of a lead protrudes from the front-end opening of a front tool.

FIGS. 19 and 20 illustrate a fifth embodiment of the present invention. In FIGS. 19 and 20, a portion (not-illustrated) is substantially the same as that of the first embodiment. Moreover, components the same as those of the first embodiment are provided with the same reference numerals and their description is omitted.

This embodiment is different from the first embodiment in that a front-end chip 30 is omitted because the front-end chip 30 is a fixed type front-end chip and a lead holder 32 is fixed in a front tool 16.

FIG. 19 shows a state in which a knock cap (not-illustrated) is knocked forwardly and a lead tank 24 and a lead-fastening chuck 22 advance similarly to the case of the first embodiment. In this case, insertion legs 34*b* of a guide pipe 34 are inserted between adjacent ribs 32*b* of a lead holder 32.

Therefore, when the guide pipe 34 advances, the insertion legs 34*b* of the guide pipe 34 do not interfere with or disturb the lead holder 32. The portion of the lead 40 at the front-end side of the lead-fastening chuck 22 is entirely surrounded and protected by the insertion legs 34*b* of the guide pipe 34 and the ribs 32*b* of the lead holder 32.

When the knock force for the knock cap is released, the lead-fastening chuck 22, a lead tank 24, and a chuck ring 23 are retracted to their initial positions by the urging force of a chuck spring 28. Moreover, the guide pipe 34 is made to follow the retraction of the lead-fastening chuck 22 by a return spring 36. In this case, because a first lead-holding portion 32*c* and a second lead-holding portion 32*e* of the lead holder 32 hold a lead 40, the lead 40 does not retreat (retract) but it keeps an advanced state. Thus, the lead 40 is delivered and fastened (held) by the lead-fastening chuck 22 again and the writing enable state is realized, as shown in FIG. 20.

In the state shown in FIG. 20, an axial-directional space is formed between the first lead-holding portion 32*c* of the lead holder 32 and the lead-fastening chuck 22. However, because the guide pipe 34 is arranged in the space and a plurality of insertion legs 34*b* of the guide pipe 34 surround the outer periphery of the lead 40, the lead 40 is protected and broken leads can be prevented from collecting in the space.

Further, the fifth embodiment achieves the same advantages as the first embodiment.

In addition to the above-described embodiments, it is also possible to respectively provide a plurality of insertion legs for the front end of a guide pipe and the rear end of a lead holder and alternately set insertion legs so as to insert the insertion legs of either of the guide pipe and the lead holder between adjacent insertion legs of the other.

As described above, according to the present invention, a lead portion ahead of a lead-fastening chuck is protected by a guide member set between the lead-fastening chuck and a lead holder. Therefore, a lead in a space between the lead-fastening chuck and the lead holder can be prevented from breaking. Further, if the lead breaks, then the broken lead can be prevented from stopping, and thus a mechanical pencil having no malfunction can be produced. Moreover, the number of components can be minimized and a very effective configuration can be achieved.

While the invention has been described in terms of several non-limiting embodiments, those skilled in the art will recognize that the invention can be practiced with modification within the spirit and scope of the appended claims.

What is claimed is:

1. A mechanical pencil, comprising:

an external cylinder;

a lead delivery mechanism disposed in said external cylinder, said lead delivery mechanism having a lead-fastening chuck which fastens a lead and moves back and forth in said external cylinder to deliver the lead toward a front end of said external cylinder;

a lead holder disposed before said lead delivery mechanism in said external cylinder to gently hold a lead; and a guide member arranged between said lead-fastening chuck and said lead holder in said external cylinder and always urged backwardly toward said lead-fastening chuck to protect a lead portion between said lead-fastening chuck and a lead holding portion of said lead holder.

2. The mechanical pencil according to claim 1, wherein either of a front end of said guide member and a rear end of said lead holder is inserted into the other, and the front end and the rear end are always overlapped in an axial direction.

3. The mechanical pencil according to claim 2, wherein said guide member includes a plurality of protective elements separate from each other in a circumferential direction to protect an outer periphery of the lead and the rear end of said lead holder is insertable between adjacent protective elements.

4. The mechanical pencil according to claim 2, wherein said guide member comprises an annular flange and a plurality of insertion legs extending forwardly from the flange and a rear end of said lead holder is insertable between adjacent insertion legs.

5. The mechanical pencil according to claim 2, wherein said guide member comprises an annular flange and a cylindrical portion formed before the flange, a plurality of ribs being formed on an inner periphery of the cylindrical portion separately from each other in the circumferential direction, and the rear end of said lead holder is insertable between adjacent ribs.

6. The mechanical pencil according to claim 2, wherein the rear end of said lead holder includes a plurality of holding elements separate from each other in the circumferential direction to hold an outer periphery of the lead, and the front end of said guide member is insertable between adjacent holding elements.

7. The mechanical pencil according to claim 2, wherein the rear end of said lead holder is formed into a cylindrical portion, a plurality of ribs are formed on an inner periphery of the cylindrical portion separately from each other in the circumferential direction, and the front end of said guide member is insertable between adjacent ribs.

8. The mechanical pencil according to claim 2, wherein the rear end of said lead holder has a plurality of insertion legs extending backward and the front end of said guide member is insertable between adjacent insertion legs.

9. The mechanical pencil according to claim 1, wherein said guide member includes a plurality of protective elements separate from each other in a circumferential direction to protect an outer periphery of the lead and a rear end of said lead holder is insertable between adjacent protective elements.

10. The mechanical pencil according to claim 1, wherein said guide member comprises an annular flange and a plurality of insertion legs extending forwardly from the flange and a rear end of said lead holder is insertable between adjacent insertion legs.

11. The mechanical pencil according to claim 1, wherein said guide member comprises an annular flange and a cylindrical portion formed before the flange, a plurality of ribs being formed on an inner periphery of the cylindrical portion separately from each other in the circumferential direction, and a rear end of said lead holder is insertable between adjacent ribs.

12. The mechanical pencil according to claim 1, wherein a rear end of said lead holder includes a plurality of holding elements separate from each other in the circumferential direction to hold an outer periphery of the lead, and a front end of said guide member is insertable between adjacent holding elements.

13. The mechanical pencil according to claim 1, wherein a rear end of said lead holder is formed into a cylindrical portion, a plurality of ribs are formed on an inner periphery of the cylindrical portion separately from each other in the circumferential direction, and a front end of said guide member is insertable between adjacent ribs.

14. The mechanical pencil according to claim 1, wherein a rear end of said lead holder includes a plurality of insertion legs extending backward and a front end of said guide member is insertable between adjacent insertion legs.

15. The mechanical pencil according to claim 1, wherein a protrusion elastically contacting an inner periphery of an external cylinder is formed on an outer periphery of said lead holder.

16. The mechanical pencil according to claim 1, wherein said lead holder is pushed forwardly by said guide member in the external cylinder and is held at an advancing position during writing.

17. The mechanical pencil according to claim 1, wherein said lead holder is unmovable under operation in the external cylinder.

18. A mechanical pencil, comprising:

an external cylinder;

a lead delivery mechanism disposed in said external cylinder, said lead delivery mechanism having a lead-fastening chuck which fastens a lead and moves back and forth in said external cylinder to deliver the lead toward a front end of said external cylinder;

a lead holder disposed adjacent said lead delivery mechanism in said external cylinder to hold a lead; and a guide member arranged between said lead-fastening chuck and said lead holder in said external cylinder and urged backwardly toward said lead-fastening chuck to protect a lead portion between said lead-fastening chuck and a lead holding portion of said lead holder.

19. The mechanical pencil according to claim 18, wherein either of a front end of said guide member and a rear end of said lead holder is inserted into the other, and the front end and the rear end are overlapped in an axial direction.

* * * * *